US006941083B1

(12) United States Patent
Muratani

(10) Patent No.: US 6,941,083 B1
(45) Date of Patent: Sep. 6, 2005

(54) IMAGE FORMING APPARATUS WITH IMAGE DEVIATION CORRECTION FUNCTION

(75) Inventor: Masataka Muratani, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/851,141

(22) Filed: May 24, 2004

(51) Int. Cl.[7] ..... G03G 15/00
(52) U.S. Cl. ..... 399/49; 399/308; 399/372
(58) Field of Search ... 399/49, 308, 372; 358/405–406

(56) References Cited

FOREIGN PATENT DOCUMENTS

| | | | | |
|---|---|---|---|---|
| JP | 2000-305324 A | | 11/2000 | |
| JP | 2002-006718 A | | 1/2002 | |
| JP | 2002091112 A | * | 3/2002 | ..... G03G 15/01 |
| JP | 2003-241610 A | | 8/2003 | |

OTHER PUBLICATIONS

U.S. Appl. No. 10/724,157, filed Dec. 1, 2003, Muratani.

* cited by examiner

*Primary Examiner*—Arthur T. Grimley
*Assistant Examiner*—Peter Lee
(74) *Attorney, Agent, or Firm*—Foley & Lardner LLP

(57) ABSTRACT

The image forming apparatus having an image deviation correction function of the present invention measures passing waveforms of correction patterns on a transfer belt printed in the main scanning direction in a relationship of a reflected image and correction patterns thermally fixed on a sheet of paper by detection sensors and from measured results, obtains main scanning magnification Sp2 and center position deviation amount $Z_{CR}$ for double-side horizontal deviation correction with high accuracy. During double-side image forming, a toner image on the first side is printed at a main scanning magnification of 100%, while a toner image on the second side is printed using a correction signal to which main scanning magnification Sp2 and center position deviation amount $Z_{CR}$ are applied, thus horizontal deviation of double-side image forming is corrected.

22 Claims, 7 Drawing Sheets

IMAGE FORMING APPARATUS WITH IMAGE DEVIATION CORRECTION FUNCTION

BACKGROUND OF THE INVENTION

1. Field of the Invention

The present invention relates to an image forming apparatus having an image deviation correction function capable of forming images on both sides of a sheet of paper by a printer or a copier.

2. Description of the Related Art

There is an image forming apparatus for forming images on both sides of a sheet of paper by an electro-photographic method such as a copier or a printer. In such an image forming apparatus, an image forming operation is performed on the first side of a sheet of paper, and then the sheet of paper is turned upside down and is conveyed again to the transfer portion, and the image forming operation is performed on the second side.

On the other hand, the sheet of paper, since water evaporates by heating at the time of fixing during the image forming operation, shrinks in size. The thermal shrinkage of the sheet of paper, when time elapses, is restored almost to its original size. Therefore, a toner image is heated, pressurized, and fixed on the first side of the sheet of paper, and then the sheet of paper is stacked once on the stack until the sheet of paper is restored to its original size and is conveyed again, and the image forming operation is performed on the second side, thus there is no fear of an occurrence of an effect of image deviation due to thermal shrinkage on the first and second sides.

However, at the request of speed-up and miniaturization of the image forming apparatus, when obtaining images on both sides, the time from execution of the image forming operation on the first side of a sheet of paper to execution of the image forming operation on the second side by re-conveying is required to be shortened. Therefore, in recent years, an apparatus for performing the image forming operation on the first side of a sheet of paper, then turning over the sheet of paper during passing on the re-conveying path without stacking it once on the stack, and immediately re-conveying it to the transfer portion has been put into practical use.

However, in such a high-speed double-side image forming apparatus, a sheet of paper thermally shrunk due to fixing during image forming on the first side, before restoration to its original size, is subject to the image forming operation on the second side by re-conveying. As a result, when the sheet of paper is restored to its original size after the image forming operation on the second side of the sheet of paper by re-conveying, between the formed image on the first side and the formed image on the second side by re-conveying, an image deviation due to thermal shrinkage is caused.

The image deviation between the first side and the second side of the sheet of paper is caused not only by thermal shrinkage of the sheet of paper but also by the re-conveying accuracy of the sheet of paper in the re-conveying path. Furthermore, due to the dimensional accuracy of a sheet of paper to be used, an image deviation is caused between the first side and the second side of the sheet of paper.

Therefore, conventionally, in Japanese Patent Published Application 2000-305324, an image forming apparatus of a high function for forming marks in the four corners of the first side of a recording medium, after fixing, reading the position relationship of the edges and marks of the recording medium by a line sensor, and from the read results, correcting a deviation between the main scanning direction and the sub-scanning direction of the second side is disclosed. However, in this image forming apparatus, to detect the mark position, an expensive line sensor must be used, disturbing a decrease in cost.

Furthermore, conventionally, in Japanese Patent Published Application 2003-241610, an image forming apparatus for, during conveying a transfer material to the detector twice, measuring the length of the transfer material before passing the fixing roller and the length of the transfer material after passing the fixing roller and from the changing amount, correcting a deviation between the main scanning direction and the sub-scanning direction of the second side is disclosed. However, in this image forming apparatus, the changing amount in the length of the transfer material is measured and from the results, a deviation between the main scanning direction and the sub-scanning direction of the second side is corrected. Namely, regarding the main scanning direction, the changing amount in the width of the transfer material is not measured, so that the correction of the deviation in the sub-scanning direction is applied as it is. Therefore, in the main scanning direction, the deviation correction accuracy is reduced. Furthermore, the center position deviation of the transfer material caused by the accuracy at the time of re-conveying of the transfer material cannot be measured, thus the deviation correction accuracy in the main scanning direction is reduced.

Therefore, in an image forming apparatus for executing the image forming process on both sides of a sheet of paper, an image forming apparatus having an image deviation correction function for, although at a low price and easily controllable, preventing an image deviation in the main scanning direction caused on the first and second sides of the sheet of paper and easily obtaining double-side images of high quality is desired.

SUMMARY OF THE INVENTION

An object of the present invention is to provide an image forming apparatus having an image deviation correction function for preventing the cost from rising, executing image positioning in the main scanning direction of the first and second sides of a sheet of paper with high precision, and obtaining double-side images of high quality.

According to the embodiments of the present invention, the image forming apparatus having an image deviation correction function includes an image forming portion having a toner image forming unit for forming a toner image on an image carrying member, a transfer unit for transferring the toner image on the image carrying member to a recording medium, a fixing unit for heating and fixing the toner image on the recording medium, and a re-conveying unit for re-conveying the recording medium with the toner image fixed on to the transfer unit, which can form the toner image on both sides of the recording medium, a first memory unit for storing correction patterns for image adjustment when forming the toner image on both sides of the recording medium, a measured member on which the correction patterns are printed, an image adjustment controller for controlling the toner image forming unit so as to print a pair of the correction patterns respectively on the recording medium and measured member in the main scanning direction, a first measuring means for measuring the passing waveforms of the paired correction patterns printed on the measured member, a second measuring means for measuring the passing waveforms of the paired correction patterns printed on the recording medium and then heated and fixed by the fixing unit, a calculator for calculating a second ratio of "the non-printed part passing time in the total length of the correction pattern" to "the passing time through the total length of the pattern" from the second measured results by the second measuring means and from the calculation results, calculating the correction value of the main scanning magnification of the toner image and the correction value of the main scanning reference position at the time of toner image forming on the first side of the recording medium and at the time of toner image forming on the second side, a second memory unit for storing the correction value of the main scanning magnification and the correction value of the main scanning reference position, and a correction controller for, when forming toner images on both sides of the recording medium, applying the correction value of the main scanning magnification and the correction value of the main scanning reference position to the toner image on either of the first side and the second side and controlling deviation correction in the main scanning direction.

Furthermore, according to the embodiments of the present invention, the image forming apparatus having an image deviation correction function includes an image forming portion having a toner image forming unit for forming a toner image on an image carrying member, a transfer belt for primarily transferring the toner image on the image carrying member and then secondarily transferring it to a recording medium, a fixing unit for heating and fixing the toner image on the recording medium, and a re-conveying unit for re-conveying the recording medium with the toner image fixed on to the transfer unit, which can form the toner image on both sides of the recording medium, a first memory unit for storing correction patterns for image adjustment when forming the toner image on both sides of the recording medium, an image adjustment controller for controlling the toner image forming unit so as to print a pair of the paired correction patterns respectively on the recording medium and transfer belt in the main scanning direction, a first measuring means for measuring the passing waveforms of the paired correction patterns printed on the transfer belt, a second measuring means for measuring the passing waveforms of the paired correction patterns printed on the recording medium and then heated and fixed by the fixing unit, a calculator for calculating a second ratio of "the non-printed part passing time in the total length of the correction pattern" to "the passing time through the total length of the pattern" from the second measured results by the second measuring means and from the calculation results, calculating the correction value of the main scanning magnification of the toner image and the correction value of the main scanning reference position at the time of toner image forming on the first side of the recording medium and at the time of toner image forming on the second side, a second memory unit for storing the correction value of the main scanning magnification and the correction value of the main scanning reference position, and a correction controller for, when forming toner images on both sides of the recording medium, applying the correction value of the main scanning magnification and the correction value of the main scanning reference position to the toner image on either of the first side and the second side and controlling deviation correction in the main scanning direction.

Furthermore, according to the embodiments of the present invention, the image forming apparatus having an image deviation correction function includes an image forming portion having a toner image forming unit for forming a toner image on an image carrying member, a conveyor belt for supporting and conveying a recording medium during transferring the toner image onto the recording medium from the image carrying member, a fixing unit for heating and fixing the toner image on the recording medium, and a re-conveying unit for re-conveying recording medium with the toner image fixed on to the transfer unit, which can form the toner image on both sides of the recording medium, a first memory unit for storing correction patterns for image adjustment when forming the toner image on both sides of the recording medium, an image adjustment controller for controlling the toner image forming unit so as to print a pair of the correction patterns respectively on the recording medium and conveyor belt in the main scanning direction, a first measuring means for measuring the passing waveforms of the paired correction patterns printed on the conveyor belt, a second measuring means for measuring the passing waveforms of the paired correction patterns printed on the recording medium and then heated and fixed by the fixing unit, a calculator for calculating a second ratio of "the non-printed part passing time in the total length of the correction pattern" to "the passing time through the total length of the pattern" from the second measured results by the second measuring means and from the calculation results, calculating the correction value of the main scanning magnification of the toner image and the correction value of the main scanning reference position at the time of toner image forming on the first side of the recording medium and at the time of toner image forming on the second side, a second memory unit for storing the correction value of the main scanning magnification and the correction value of the main scanning reference position, and a correction controller for, when forming toner images on both sides of the recording medium, applying the correction value of the main scanning magnification and the correction value of the main scanning reference position to the toner image on either of the first side and the second side and controlling deviation correction in the main scanning direction.

DETAILED DESCRIPTION OF THE INVENTION

The embodiments of the present invention will be explained in detail below with reference to the accompanying drawings.

Figure 1:
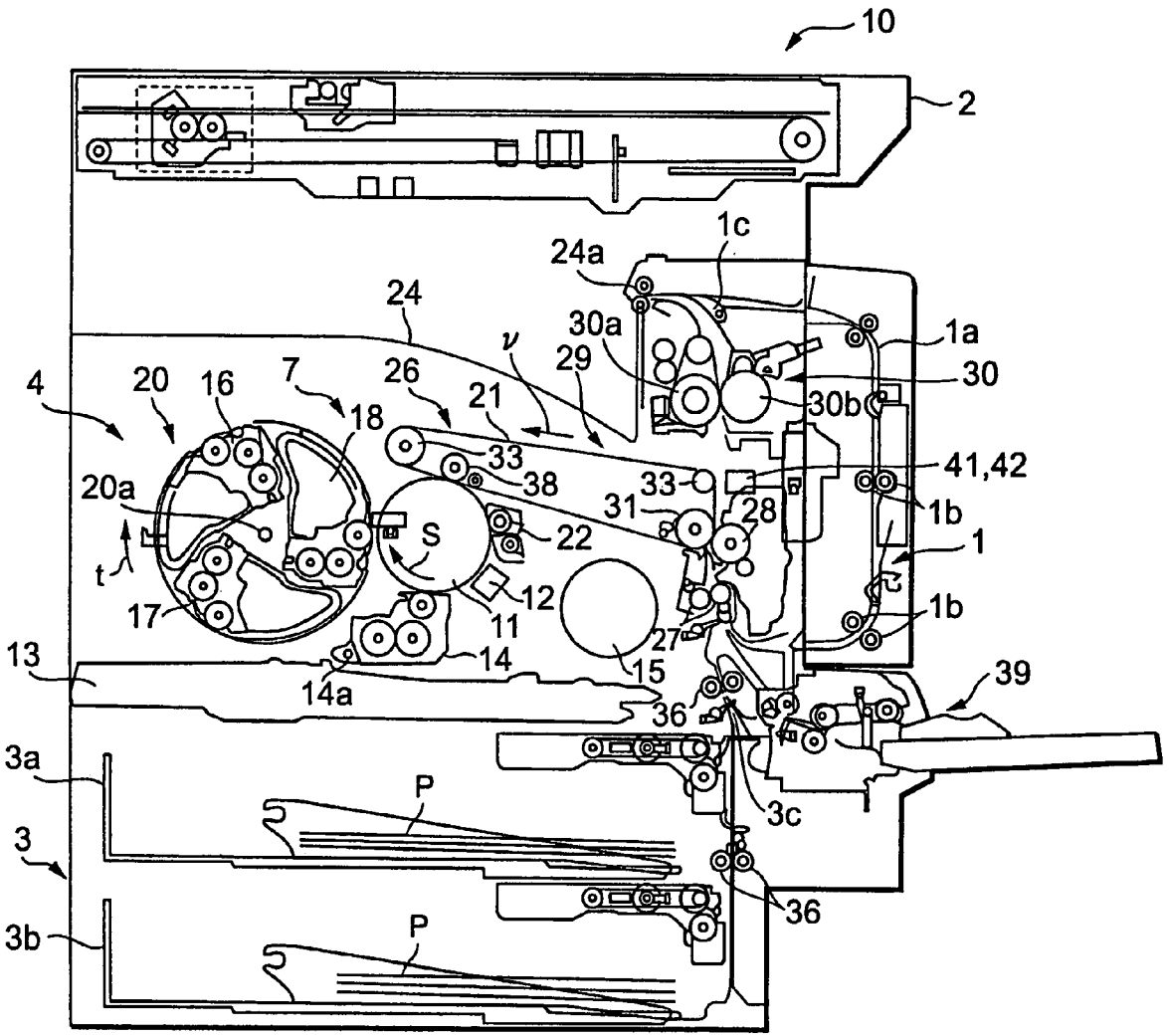
FIG. 1 is a block diagram schematically showing the digital copier of the first embodiment of the present invention.

FIG. 1 is a schematic block diagram showing the whole of color digital copier 10 which is an image forming apparatus of the first embodiment of the present invention. Digital copier 10 is composed of scanner 2 for reading a document image and obtaining image data, printer 4 which is an image forming portion for forming an image on the basis of the image data obtained by scanner 2 on a sheet of paper which is a recording medium, and paper supply device 3 for supplying a sheet of paper, which is a recording medium, to printer 4, wherein printer 4 has duplex device 1 which is a re-conveying unit for inverting the front and rear which are the first side and second side of a sheet of paper on one side of which a toner image is formed and re-conveying it to aligning rollers 27 in printer 4.

Paper supply device 3 takes out sheet of paper P from paper supply cassettes 3*a* and 3*b* and supplies sheet of paper P to aligning rollers along conveying path 3*c* having conveying rollers 36. [page 7] Furthermore, paper supply device 3 has manual paper supply unit 39 for manually supplying sheet of paper P to aligning rollers 27. Printer 4 has toner image forming unit 7 for forming a toner image on photosensitive drum 11 which is an image carrying member, transfer unit 29 for transferring a toner image formed on photosensitive drum 11 onto sheet of paper P, and fixing device 30 for heating, pressurizing, and fixing a toner image on sheet of paper P. Duplex device 1 has reversing path 1*a*, re-conveying rollers 1*b*, and moreover gate 1*c* for leading sheet of paper P switched back using exit roller pair 24*a* for ejecting sheet of paper P to paper exit 24 to reversing path 1*b* after passing fixing device 3.

Around photosensitive drum 11, main charger 12 for sequentially charging evenly photosensitive drum 11 in the rotational direction of arrow s of photosensitive drum 11 and revolver type color developing device 20 loading laser exposure 13, black developing unit 14, yellow (Y) developing unit 16, magenta (M) developing unit 17, and cyan (C) developing unit 18 for forming latent images on charged photosensitive drum 11 on the basis of image data from scanner 2 are installed.

Black developing unit 14 can rotate around supporting point 14*a* and can make contact with and separate from photosensitive drum 11. To black developing unit 14, toner is supplied from black toner bottle 15. Color developing device 20 sequentially rotates around rotation axis 20*a* in the direction of arrow t, and yellow (Y), magenta (M), and cyan (C) developing units 16 to 18 are arranged opposite to photosensitive drum 11 and sequentially supply yellow (Y), magenta (M), and cyan (C) toners to photosensitive drum 11.

Furthermore, around photosensitive drum 11, transfer belt device 26 having transfer belt 21 that is transfer unit 29 and a measured member and cleaner 22 are arranged. Transfer belt 21 is stretched and suspended by driving roller 31 and tension roller 33. The primary transfer position where transfer belt 21 makes contact with photosensitive drum 11 is supported by primary transfer roller 38 for impressing a primary transfer bias voltage. To the secondary transfer position supported by driving roller 31 of transfer belt 21, secondary transfer roller 28 for impressing a secondary transfer bias voltage is opposite.

Figure 3:
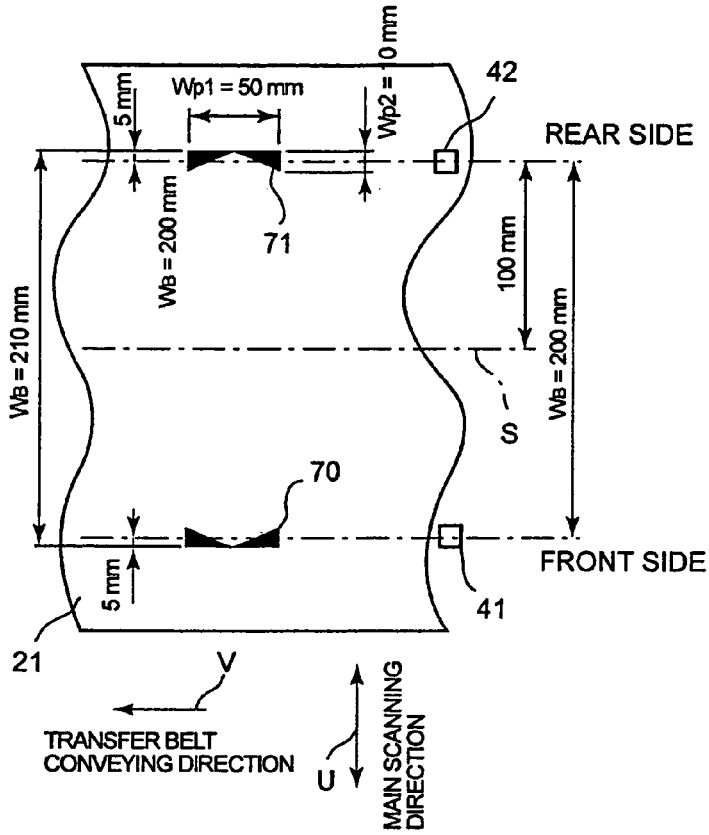
FIG. 3 is an illustration showing the correction pattern and detection sensor position on the transfer belt of the first embodiment of the present invention.

Fixing device 30 which is a fixing unit has heat roller 30*a* having a built-in heater lamp and press roller 30*b*. On the downstream side of secondary transfer roller 28, at the position opposite to transfer belt 21 via the conveying path of sheet of paper P, a pair of detection sensors 41 and 42 serving both as a first measuring means and a second measuring means are installed on the front side and rear side. Paired detection sensors 41 and 42, at the position opposite to transfer belt 21 supported by tension roller 33, as shown in FIG. 3, are arranged symmetrically about center S of the toner image indicated in the direction of arrow u in the main scanning direction. Gap Ws between detection sensors 41 and 42 on the front side and rear side is equal to 200 mm. Detection sensors 41 and 42 are composed of reflection type photo-sensors for detecting a toner image by detecting reflected light.

Figure 5:
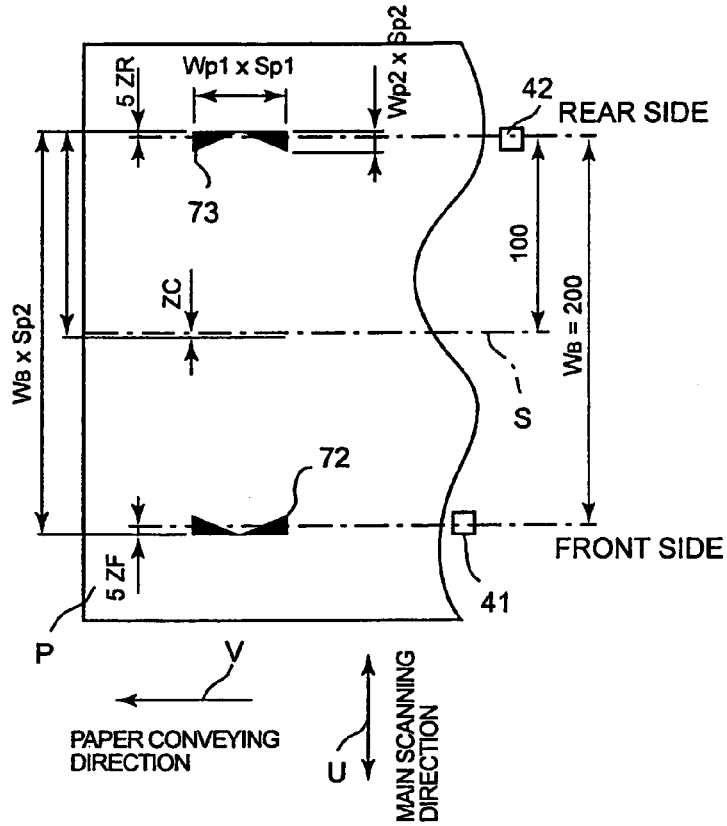
FIG. 5 is an illustration showing the correction pattern and detection sensor position on a sheet of paper after fixing of the first embodiment of the present invention.

Since arranged as mentioned above, paired detection sensors 41 and 42, as shown in FIG. 3, measure the passing waveforms of paired correction patterns 70 and 71 on the front side and rear side which are printed on transfer belt 21 for image adjustment at the time of double-side image forming. Further, paired detection sensors 41 and 42, as shown in FIG. 5, for image adjustment at the time of double-side image forming, measure the passing waveforms of paired correction patterns 72 and 73 on the front side and rear side which are printed on the first side of sheet of paper P turned upside down by duplex device 1 after fixing.

Correction patterns 70 to 73 are composed of solid patterns in a shape that for example, the central part of a rectangular solid image with width Wp1 of 50 mm in the sub-scanning direction which is the conveying direction of transfer belt 21 and width Wp2 of 10 mm in the main scanning direction is cut off to a triangle. Paired correction patterns 70 and 71 printed on transfer belt 21 and paired correction patterns 72 and 73 printed on sheet of paper P are respectively in a relationship of a reflected image to center S in the main scanning direction.

The print position of correction patterns 70 to 73 corresponds to the arrangement position of detection sensors 41 and 42. Interval $W_B$ between paired correction patterns 70 and 71 and between paired correction patterns 72 and 73 is equal to 210 mm. Therefore, when there is no image deviation, detection sensors 41 and 42 are in a position relationship that they cross the central part (the position at a distance of 5 mm from the outside of the correction patterns) of the width of 10 mm of paired correction patterns 70 and 71 printed on transfer belt 21 and paired correction patterns 72 and 73 printed on sheet of paper P in the main scanning direction.

Figure 2:
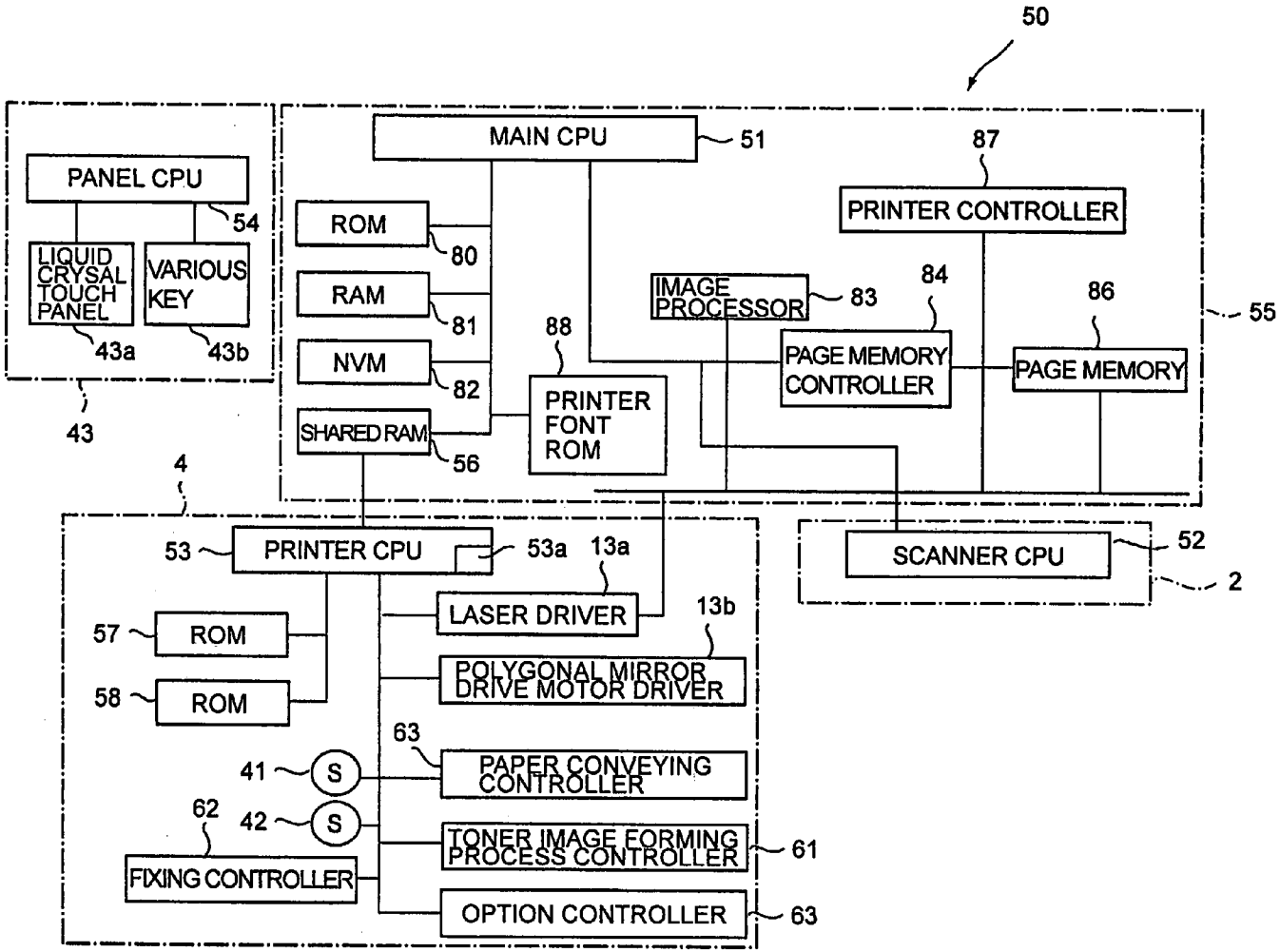
FIG. 2 is a block diagram showing the control system of the digital copier of the first embodiment of the present invention.

FIG. 2 is a block diagram showing control system 50 of digital copier 10. Control system 50 has main controller 55 for controlling whole digital copier 10, scanner CPU 52 for controlling scanner 2, printer CPU 53 having calculator 53*a* which controls printer 4 and serves as a correction controller, and panel CPU 54 for controlling liquid crystal touch panel 43*a* and various keys 43*b* on operation panel 43.

Main controller 55 has main CPU 51, ROM 80, RAM 81, NVM 82, shared RAM 56, image processor 83, page memory controller 84, page memory 86, printer controller 87, and printer font ROM 88. Operation panel 43 sets image forming conditions in the print mode in printer 4 or displays the condition status of printer 4.

Main CPU 51 executes two-way communication with scanner CPU 52, printer CPU 53, and panel CPU 54. Printer CPU 53 executes two-way communication with main CPU 51 via shared RAM 56. Main CPU 51 outputs an operation instruction to printer CPU 53 and printer CPU 53 returns the condition status to main CPU 51. Printer CPU 53 and scanner CPU 52 execute serial communication, and printer CPU 53 outputs an operation instruction to scanner CPU 52, and scanner CPU 52 returns the condition status to printer CPU 53.

Printer 4 is composed of printer CPU 53, ROM 57 for storing beforehand correction pattern data for printing the control program or correction patterns 70 to 73, RAM 58 for storing various data which serves both as a first memory unit and a second memory unit, laser driver 13*a* for controlling to turn on or off a laser beam by laser exposure 13, polygonal mirror drive motor driver 13*b* for controlling the rotation of the polygonal mirror drive motor of laser exposure 13, paper conveying controller 60 for controlling conveying of sheet of paper P by paper supply device 3 or duplex device 1, toner image forming process controller 61 for executing the charging step, developing step, and transferring step on photosensitive drum 11 and forming a toner image, fixing controller 62 for controlling fixing device 30, and option controller 63 for controlling other optional devices. Furthermore, to printer CPU 53, detection sensors 41 and 42 mentioned above are connected.

Next, by referring to FIG. 7, the process of horizontal deviation correction for performing the image forming process on both sides of sheet of paper P by digital copier 10 will be explained. In this embodiment, patterns 70 and 71 formed on transfer belt 21 and patterns 72 and 73 formed on sheet of paper P are measured by detection sensors 41 and 42 and from the measured results, the horizontal deviation amount caused by thermal shrinkage of sheet of paper P due to fixing and the horizontal deviation amount caused by reversing conveying are obtained. The horizontal deviation correction process is performed for each of sheets of paper P used for double-side image forming. According to the obtained horizontal deviation amount, for each of sheets of paper P, deviation correction in the main scanning direction during image forming on the second side is executed.

Before starting the horizontal deviation correction process during double-side image forming on sheets of paper P, firstly at Step 100, the main scanning magnification and main scanning reference position of the transfer pattern on the first side are adjusted. The deviation correction of the transfer pattern on the first side adjusts so as to obtain a position relationship that in FIG. 3, detection sensors 41 and 42 accurately cross the position at a distance of 5 mm from the outside of the correction pattern which is the central part of paired correction patterns 70 and 71 printed on transfer belt 21 in the main scanning direction.

Figure 4:
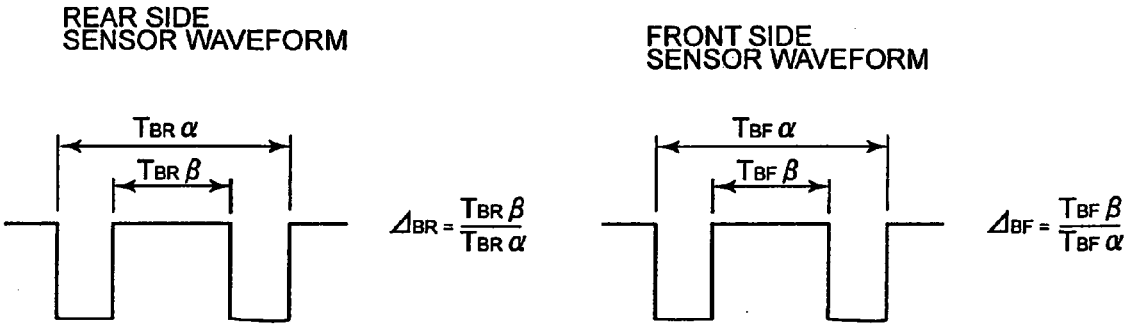
FIG. 4 is an illustration showing the passing waveform of the correction pattern on the transfer belt of the first embodiment of the present invention.

When the deviation amount of the transfer pattern onto the first side of sheet of paper P is 0, on the front side and rear side, the ratios (first ratios) ΔBF and ΔBR of "$T_{BF_\beta}$ and $T_{BR_\beta}$ which are the non-printed part passing hours in the total length of the correction patterns respectively on the front side and rear side" shown in FIG. 4 when correction patterns 70 and 71 pass detection sensors 41 and 42 to "$T_{BF\partial}$ and $T_{BR\partial}$ which are the passing hours through the total length of the respective patterns on the front side and rear side" are all 0.50.

Therefore, $\Delta BF=T_{BF_\beta}/T_{BF_\partial}=0.50$, and $\Delta BR=T_{BR_\beta}/T_{BR\partial}=0.50$, and $\Delta BF+\Delta BR=1.00$.

For the positions of detection sensors 41 and 42, the deviation amounts of correction patterns 70 and 71 in the main scanning direction are proportional to the changing amounts of ΔBF and ΔBR. Therefore, from the changing amount of ΔBF or ΔBR, the deviation amounts (mm) of correction patterns 70 and 71 for the positions of detection sensors 41 and 42 in the main scanning direction can be calculated. Further, this relationship can be applied to detection of the deviation amounts (mm) of correction patterns 72 and 73 on sheet of paper P for detection patterns 41 and 42 shown in FIG. 5 in the "double-side horizontal deviation adjustment mode".

Figure 6:
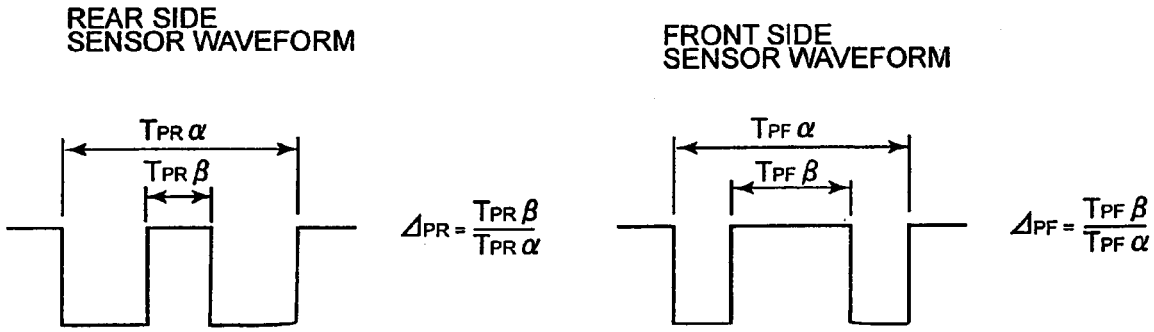
FIG. 6 is an illustration showing the passing waveform of the correction pattern on a sheet of paper after fixing of the first embodiment of the present invention.

The ratios (second ratios) of "$T_{PF_\beta}$ and $T_{PR_\beta}$ which are the non-printed part passing hours in the total length of the correction patterns respectively on the front side and rear side" shown in FIG. 6 to "$T_{PF\partial}$ and $T_{PR\partial}$ which are the passing hours through the total length of the respective patterns on the front side and rear side" are assumed as ΔPF and ΔPR.

Here, for detection of the deviation amounts of correction patterns 70 to 73, the first ratios or the second ratios are used, so that effects of changes of the magnification of correction patterns 70 to 73 in the sub-scanning direction are eliminated. Further, paired correction patterns 70 and 71 are printed in a relationship of a reflected image to center S in the main scanning direction, so that when the main scanning magnification of correction patterns 70 and 71 is accurately 1.00, even if the center position of paired correction patterns 70 and 71 is deviated from the center position of detection sensors 41 and 42, when $W_B$=210 mm, a relationship of ΔBF+ΔBR= 1.00 is kept.

To obtain the aforementioned relationship of ΔBF=0.50 and ΔBR=0.50, at Step 100, the positions of detection sensors 41 and 42 and correction patterns 70 and 71 are adjusted, and the error of the main scanning magnification of the transfer pattern on the first side is set to 0, and the deviation of the main scanning reference position is adjusted to 0, and then the horizontal deviation correction process at the time of double-side image forming is executed for each sheet of paper to be used. Actually, "double-side horizontal deviation adjustment mode" is instructed from operation panel 43 and the stage of paper supply cassettes 3*a* and 3*b* of paper supply device, the size of sheets of paper, and the kind of sheets of paper such as ordinary paper or thick paper are selected.

At Step 101, the instruction of "double-side horizontal deviation adjustment mode" is confirmed, and then at Step 102, the selection of the stage of paper supply cassettes 3*a* and 3*b* of paper supply device and the size and kind of sheets of paper is confirmed, and printer 4 is switched to "double-side horizontal deviation adjustment mode", and the process goes to Step 103. At Step 103, using the correction pattern data stored in ROM 57 beforehand, in the same way as with the image forming process which will be described later, a single-color toner image is formed by magenta (M) developing unit 17, and paired correction patterns 70 and 71 of single-color toner of magenta (M) are printed on transfer belt 21.

Correction patterns 70 and 71 are formed by magenta (M), so that on either of black transfer belt 21 and white sheet of paper P, correction patterns 70 to 73 can be measured easily by detection sensors 41 and 42. Further, the color of toner for forming correction patterns 70 to 73 is not limited to magenta (M) and when correction patterns 70 to 73 can be measured easily on either of black transfer belt 21 and white sheet of paper P, yellow (Y) or cyan (C) can be optionally used. When printing correction patterns 70 and 71 on transfer belt 21, sheet of paper P is not conveyed to the position of secondary transfer roller 28. Further, secondary transfer roller 28 is separated from the transfer belt.

Next, at Step 104, correction patterns 70 and 71 are measured by detection sensors 41 and 42 and from the measured results, ΔBF, ΔBR, and ΔBF+ΔBR are calculated and are stored in RAM 58. Furthermore, at Step 106, it is discriminated whether the stored values of ΔBF, ΔBR, and ΔBF+ΔBR are within predetermined tolerances such as ΔBF=0.50, ΔBR=0.50, and ΔBF+ΔBR=1.00.

At Step 106, when the stored values of ΔBF, ΔBR, and ΔBF+ΔBR are within the predetermined tolerances and it is judged that the deviation amount of the transfer pattern onto the first side of sheet of paper P is 0, the process goes to Step 108. When the stored values of ΔBF, ΔBR, and ΔBF+ΔBR are beyond the predetermined tolerances and it is judged that the transfer pattern onto the first side of sheet of paper P is deviated, the process goes to Step 107, and suspension of "double-side horizontal deviation adjustment mode" is displayed on operation panel 43, and then the process returns to Step 100, and the deviation amount of the transfer pattern onto the first side of sheet of paper P is adjusted to be 0.

At Step 108, sheet of paper P is conveyed to the position of secondary transfer roller 28 and correction patterns 70 and 71 to be printed on transfer belt 21 are secondarily transferred to the first side of sheet of paper P. Furthermore, correction patterns 72 and 73 secondarily transferred to the first side of sheet of paper P are heated, pressurized, and fixed by fixing device 30, and then sheet of paper P is turned upside down by duplex device 1 and is re-conveyed to secondary transfer roller 28 and then toward exit rollers 24*a* via aligning rollers 27.

Next, at Step 110, correction patterns 72 and 73 of sheet of paper P to be re-conveyed by detection sensors 41 and 42 are measured and from the measured results, $\Delta PF=T_{PF_\beta}/T_{PF_\partial}$ and $\Delta PR= T_{PR_\beta}/T_{PR\partial}$ are calculated and are stored in RAM 58. Next, at Step 111, from the stored values of ΔPF and ΔPR, main scanning magnification Sp2 to be applied during the image forming process onto the second side of sheet of paper P and reference position deviation amount (the deviation amount between the center position of correction patterns 72 and 73 and the center position of detection sensors 41 and 42 in the main scanning direction) $Z_{CR}$ in the main scanning direction are calculated.

Furthermore, at Step 112, the data of main scanning magnification Sp2 and reference position deviation amount $Z_{CR}$ in the main scanning direction which are calculated is stored in RAM 58 and the "double-side horizontal deviation adjustment mode" of the sheet of paper of the size and kind which are confirmed at Step 102 is finished. Hereafter, also for other sheets of paper of paper supply device 3, Steps 100 to 112 shown in FIG. 5 are executed and the "double-side horizontal deviation adjustment mode" is executed for each sheet of paper. Further, whenever the sheets of paper in paper supply cassettes 3*a* and 3*b* are exchanged to another kind, the "double-side horizontal deviation adjustment mode" is executed for the exchanged sheets of paper.

Next, the calculation of main scanning magnification Sp2 and center position deviation amount $Z_C$ in the main scanning direction at Step 111 will be described in detail. At Step 108, in correction patterns 72 and 73 measured by detection sensors 41 and 42 after fixing on the first side of sheet of paper P, horizontal deviation caused by (1) changes in the main scanning magnification due to thermal shrinkage of sheet of paper P by fixing heat and (2) deviation of the reference position (center position deviation in the main scanning direction) in the main scanning direction due to effects of the conveying accuracy of duplex device 1 occurs.

Assuming the sub-scanning magnification due to temporary thermal shrinkage of sheet of paper P by fixing heat as Sp1 and the main scanning magnification due to temporary thermal shrinkage of sheet of paper P by fixing heat as Sp2, the width of correction patterns 72 and 73 in the main scanning direction measured by detection sensors 41 and 42 at the time of re-conveying via duplex device 1 is 10×Sp2 mm. (At this time, the width in the sub-scanning direction is 50×Sp1 mm.)

Therefore, at the time of image forming on the second side of sheet of paper P, if image forming is executed by applying the magnification at the time of thermal shrinkage, when time elapses and sheet of paper P is restored to its original size, the main scanning magnification of the second side is returned to 100% and image deviation of both sides due to thermal shrinkage is corrected.

Next, the calculation of (1) changes in the main scanning magnification due to thermal shrinkage of sheet of paper P by fixing heat mentioned above will be described. By temporary thermal shrinkage of sheet of paper P, the image width taken in interval Ws between detection sensors 41 and 42 is increased compared with that before shrinkage. Assuming the increased image width as γ in the measure before shrinkage, to set the image magnification on the second side when sheet of paper P is restored to its original size to 100% which is the image magnification on the first side, main scanning magnification Sp2 to be applied at the time of image forming on the second side of sheet of paper P:

$$Sp2=Ws/(Ws+\gamma) \qquad \text{Formula 1}$$

The increased image width γ:

$$\gamma=Wp2\{1-(\Delta PF+\Delta PR)\} \qquad \text{Formula 2}$$

Therefore, when ΔPF and ΔPR are calculated from the detected results of correction patterns 72 and 73 by detection sensors 41 and 42 and the increased image width γ is obtained, desired main scanning magnification Sp2 can be obtained. (The sum of ΔPF and ΔPR is an index of main scanning magnification Sp2.) In this embodiment, Ws=200 mm and Wp2=10 mm, so that as a main scanning magnification to be applied at the time of image forming on the second side of sheet of paper P, Sp2=200/(200+γ) is obtained.

Next, the calculation of (2) center position deviation amount $Z_{CR}$ in the main scanning direction due to effects of the conveying accuracy of duplex device 1 mentioned above will be described.

(a) Firstly, in the state that thermal shrinkage of correction patterns 72 and 73 is ignored, assuming the deviation amount of correction pattern 73 on the rear side in FIG. 5 as $Z_R$ and the deviation amount of correction pattern 72 on the front side as $Z_F$, $Z_R$= Wp2(0.5−ΔPR) and $Z_F$=Wp2(0.5−ΔPF). From $Z_R$ and $Z_F$, center position deviation amount $Z_C$ when the thermal shrinkage is ignored becomes equal to $(Z_R-Z_F)/2$=Wp2(ΔPF−ΔPR)/2 and when ΔPF and ΔPR are calculated from the detection results of correction patterns 72 and 73, desired center position deviation amount $Z_C$ in the main scanning direction can be obtained.

(b) Next, in consideration of thermal shrinkage of correction patterns 72 and 73 themselves, center position deviation amount $Z_{CR}$ in the main scanning direction is:

$$Z_{CR}=Z_C\times Sp2=(Z_R-Z_F)Sp2/2=Wp2(\Delta PF-\Delta PR)Sp2/2 \qquad \text{Formula 3}$$

Therefore, using the difference between ΔPF and ΔPR as an index, center position deviation amount $Z_{CR}$ in the main scanning direction can be obtained.

Namely, when the other image forming conditions such as the fixing temperature and the sheet of paper conditions are fixed, for the image deviation amounts of toner images generated on the average on the first side and second side of sheet of paper P in the main scanning direction, at Step 111, the main scanning magnification on the second side is set to Sp2, and moreover the reference position in the main scanning direction is shifted by $Z_{CR}$, thus the image forming operation is performed. By doing this, the double-side horizontal deviation correction of sheet of paper P is executed, and when sheet of paper P is restored to its original size, the main scanning magnifications on both sides of the sheet of paper become the same value of 100%, and the image deviation on both sides due to thermal shrinkage is corrected.

For example, it is assumed that for ordinary paper of a size of A4 stored in paper supply cassette 3*a*, the "double-side horizontal deviation adjustment mode" is executed, and at Step 110, correction patterns 72 and 73 of sheet of paper P re-conveyed by detection sensors 41 and 42 are measured, and from the measured results, ΔPF=0.45 and ΔPR=0.3 are obtained. At this time, γ=2.5 mm is obtained from Formula 2, so that from Formula 1, Sp2=200/(200+2.5)≈0.988 is calculated and the image forming process on the second side of sheet of paper P is executed at main scanning magnification Sp2≈0.988. Furthermore, for the reference position in the main scanning direction, from Formula 3, $Z_{CR}$=1.5×100/202.5≈0.74 mm is calculated, and the reference position in the main scanning direction is shifted by $Z_{CR}$≈0.74 mm.

Figure 7:
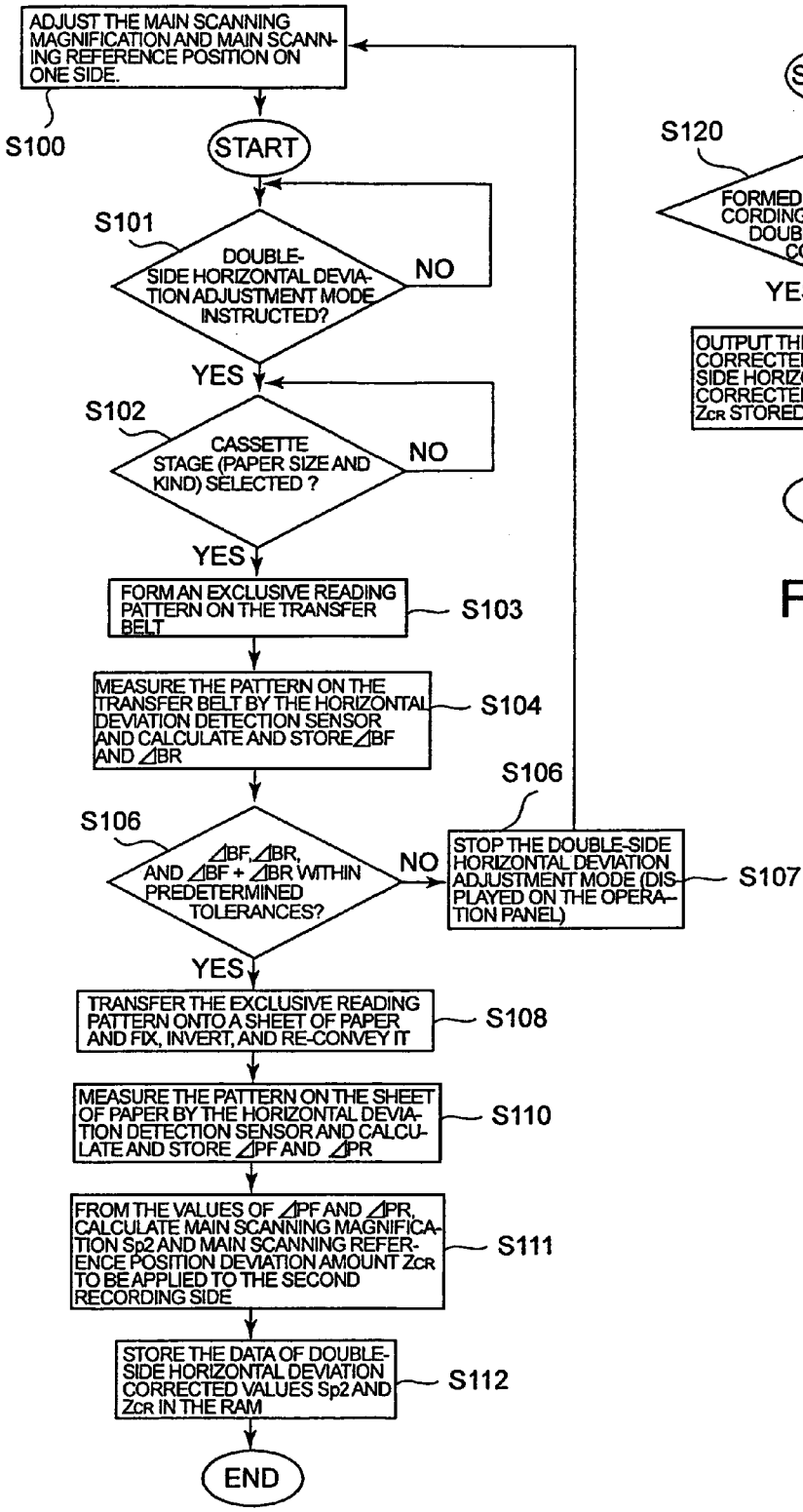
FIG. 7 is a flow chart showing the process in the double-side horizontal deviation adjustment mode of the first embodiment of the present invention.

For various kinds of sheets of paper in paper supply cassettes 3*a* and 3*b*, the "double-side horizontal deviation adjustment mode" is executed according to the flow chart shown in FIG. 7, and respective data concerning main scanning magnification Sp2 and reference position correction amount $Z_{CR}$ in the main scanning direction are stored in RAM 58, and in this state, the double-side image forming operation is executed by digital copier 10. When the double-side image forming mode and other image forming conditions are input from operation panel 43 and then copy start is instructed, digital copier 10 is set in the double-side image forming mode by main CPU 51 and firstly, image forming on the first side of sheet of paper P is executed.

For example, by copy start using ordinary paper of a size of A4 stored in paper supply cassette 3*a*, photosensitive drum 11 rotates in the direction of arrow s and is evenly charged by main charger 12. Next, to photosensitive drum 11, a laser beam according to an image processing signal from image processor 83 is irradiated at a main scanning magnification of 100% by laser exposure 13 to form a black electrostatic latent image. Next, the electrostatic latent image on photosensitive drum 11 is developed by black developing unit 14 and then is primarily transferred to transfer belt 12 for rotating the black (BK) toner image in the direction of arrow v. Hereafter, the residual toner on photosensitive drum 11 is cleaned by cleaner 22, and then the toner image forming processes of cyan (C), magenta (M), and yellow (Y) are sequentially repeated, and a full-color toner image is formed on transfer belt 21.

The full-color toner image is printed on the first side of ordinary sheet of paper P of a size of A4 conveyed from paper supply cassette 3*a* by secondary transfer roller 28. Next, sheet of paper P is heated, pressurized, and fixed by fixing device 30, then is turned upside down via duplex device 1, and is re-conveyed to aligning rollers 27. At this time, sheet of paper P is constricted by heating at the time of fixing. During re-conveying of sheet of paper P, printer 4 executes the toner image forming process for printing on the second side of sheet of paper P on photosensitive drum 11.

Figure 8:
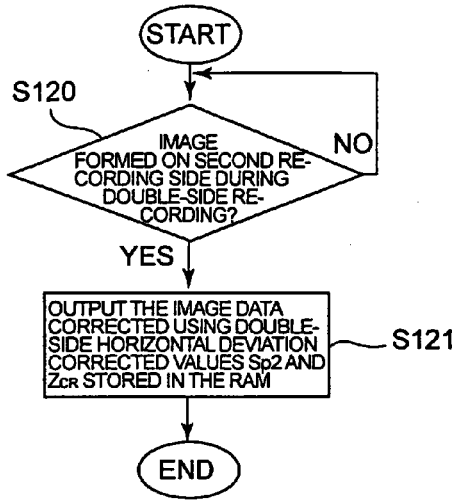
FIG. 8 is a flow chart showing the toner image forming process on the second side of a sheet of paper of the first embodiment of the present invention.

Namely, printer 4 transfers the toner image to be printed on the first side of sheet of paper P on transfer belt 21, then according to the flow chart shown in FIG. 8, sets the main scanning magnification of laser exposure 13 to Sp2, sets so as to shift the reference position in the main scanning direction, and then executes the image forming process on photosensitive drum 11. At Step 120 shown in FIG. 8, printer 4 finishes forming of the toner image to be printed on the first side of sheet of paper P and then confirms start of forming of the toner image to be printed on the second side.

Next, the process goes to Step 121 and main scanning magnification Sp2≈0.988 and center position deviation amount in the main scanning direction $Z_{CR}$≈0.74 mm which are stored in RAM 58 in the "double-side horizontal deviation adjustment mode" are applied to laser driver 13*a* and polygonal mirror drive motor driver 13*b*. Laser exposure 13 is set so as to apply main scanning magnification Sp and center position deviation amount $Z_{CR}$ to an image processing signal from image processor 83 and irradiate a laser beam according to a correction signal when the double-side horizontal deviation correction is executed.

Hereafter, in the same way as with image forming on the first side of sheet of paper P, on the second side of sheet of paper P re-conveyed, a full-color toner image of main scanning magnification Sp2≈0.988 is printed. Hereafter, sheet of paper P, after forming double-side images via fixing device 30, is ejected to paper exit 24.

A predetermined time elapses after end of the double-side image forming process, and thermally shrunk sheet of paper P is restored to its original size, and then when the toner images printed on the first side and second side of sheet of paper P are compared, the main scanning magnifications of the two are the same and no image horizontal deviation is seen.

According to the first embodiment, detection sensors 41 and 42 for measuring paired correction patterns 70 and 71 printed on transfer belt 21 in a relationship of a reflected image and paired correction patterns 72 and 73 fixed on the first side of sheet of paper P in a relationship of a reflected image are installed and from the measured results of the passing waveforms of correction patterns 70 to 73 by detection sensors 41 and 42, main scanning magnification Sp2 and center position deviation amount $Z_{CR}$ for double-side horizontal deviation correction can be obtained with high accuracy. Therefore, to detect thermal shrinkage of a sheet of paper, there is no need to detect the edge of the sheet of paper as conventional, and there is no need to execute a high degree of control by an expensive line sensor, and double-side printed images of high quality free of horizontal deviation on the first and second sides can be obtained. Further, correction patterns 70 and 71 on transfer belt 21 and correction patterns 72 and 73 on sheet of paper P are measured by same detection sensors 41 and 42, so that compared with a case that different detection sensors are used, measurement errors caused by the characteristics of the detection sensors at the time of measurement can be prevented and the measurement accuracy can be improved.

Next, the second embodiment of the present invention will be explained. In the second embodiment, a plurality of toner image forming units are arranged along the conveyor belt of sheets of paper, and to a tandem type digital copier for obtaining color images, in the same way as with the first embodiment, the "double-side horizontal deviation adjustment mode" is applied, and to the same parts as those of the constitution explained in the first embodiment, the same numerals are assigned and the detailed explanation thereof will be omitted.

Figure 9:
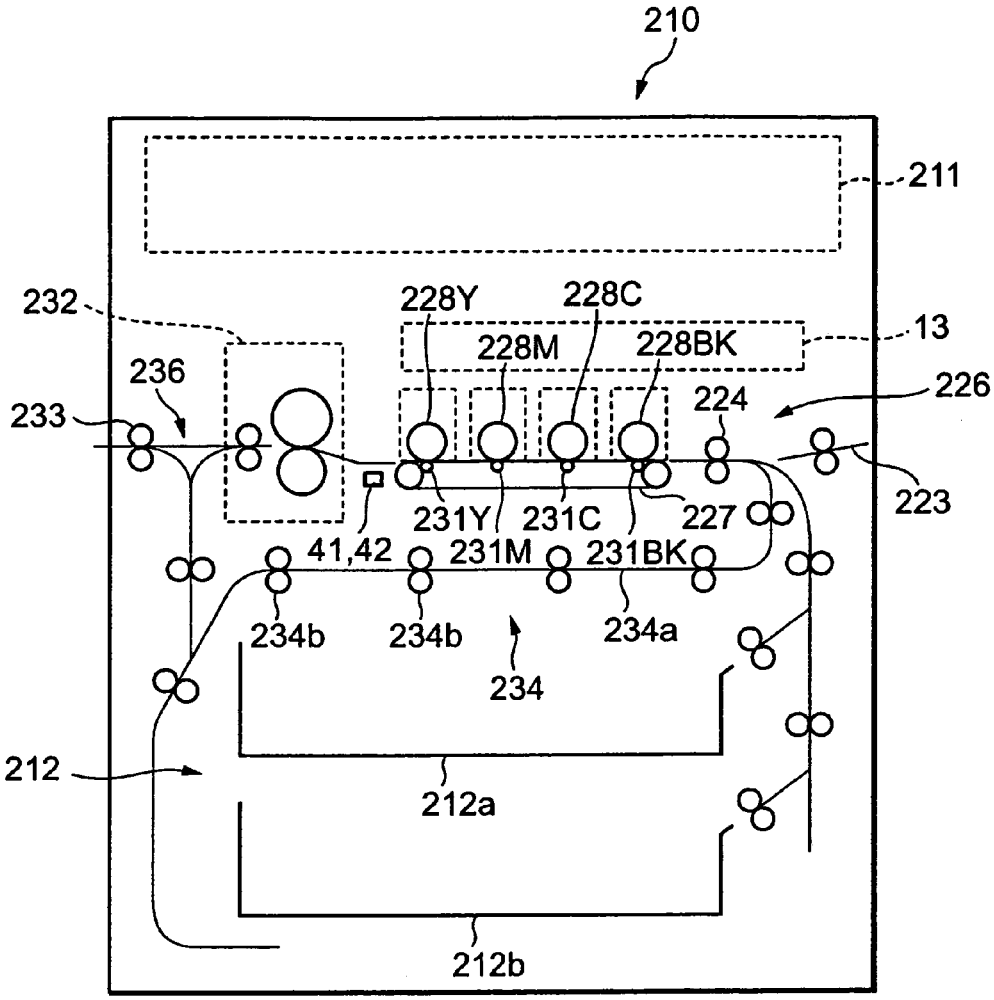
FIG. 9 is a block diagram schematically showing the essential section of the digital copier of the second embodiment of the present invention.

FIG. 9 is a schematic block diagram showing the whole of digital copier 210 of a 4-each tandem type. Digital copier 210, almost similar to the first embodiment, has a scanner 211, paper supply device 212 having paper supply cassettes 212*a* and 212*b*, manual paper supply unit 223, and aligning rollers 224. Printer 226 which is an image forming portion has photosensitive drums 228Y to 228BK arranged along conveyor belt 227 of sheets of paper. On photosensitive drums 228Y to 228BK, electrostatic latent images are formed by laser exposure 13. Further, around photosensitive drums 228Y to 228BK, four sets of image forming units 230Y to 230BK which are toner image forming units for forming toner images of yellow (Y), magenta (M), cyan (C), and black (BK) on photosensitive drums 228Y to 228BK using the electrostatic latent images by laser exposure 13 are installed.

At the positions opposite to photosensitive drums 228Y to 228BK via conveyor belt 227, transfer rollers 231Y to 231BK are installed. On the downstream side of conveyor belt 227, fixing device 232 and gate 236 for switching to ejection of sheet of paper P after fixing toward exit rollers 233 or to conveying toward duplex device 234 for re-conveying toward aligning rollers 224 are installed. Duplex device 234 has reversing path 234*a* and reversing conveying rollers 234*b*.

Figure 10:
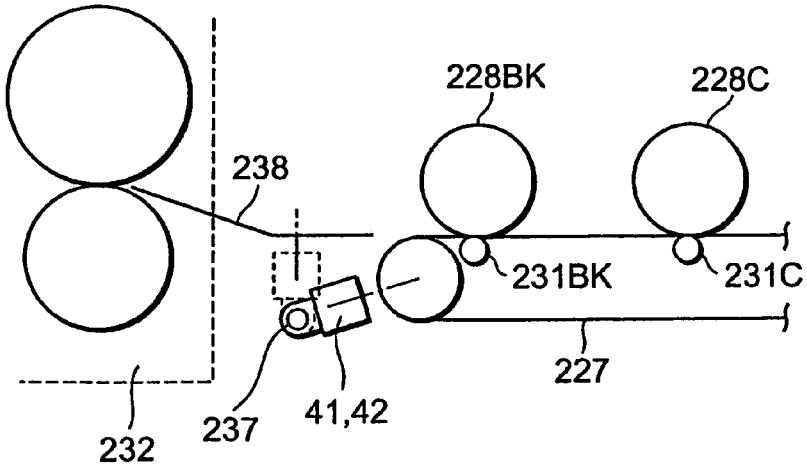
FIG. 10 is a partial block diagram showing the detection sensor of the second embodiment of the present invention.

As shown in FIG. 10, between conveyor belt 227 and fixing device 232, detection sensors 41 and 42 are installed. Detection sensors 41 and 42 are supported rotatably by moving device 237 toward conveyor belt 227 and toward sheet of paper conveying path 238.

In the "double-side horizontal deviation adjustment mode" for double-side image forming, magenta (M) image forming unit 230M prints correction patterns 70 and 71 which are the same pattern on conveyor belt 227 and prints correction patterns 72 and 73 on the first side of sheet of paper P. Sheet of paper P, after correction patterns 72 and 73 are fixed by fixing device 232, is turned upside down by duplex device 234 and is re-conveyed toward conveyor belt 227 via aligning rollers 224.

Detection sensors 41 and 42, at the position indicated by a solid line in FIG. 10, measure the passing waveforms of correction patterns 70 and 71 on conveyor belt 227. From the measured results, detection sensors 41 and 42 calculate ΔBF, ΔBR, and ΔBF+ΔBR, and when the calculated results are within predetermined tolerances, execute the "double-side horizontal deviation adjustment mode". Next, when detection sensors 41 and 42 are at the position indicated by a dotted line in FIG. 10, detection sensors 41 and 42 measure the passing waveforms of correction patterns 72 and 73 fixed on the first side of sheet of paper P which is turned upside down by duplex device 234 and is re-conveyed. From the measured results, detection sensors 41 and 42 calculate ΔPF and ΔPR and store them in RAM 58. Furthermore, from the stored values of ΔPF and ΔPR, detection sensors 41 and 42 calculate main scanning magnification Sp2 and reference position deviation amount $Z_{CR}$ in the main scanning direction which are applied during the image forming process on the second side of sheet of paper P and store them in RAM 58.

During image forming in the double-side image forming mode, using image forming units 230Y to 230BK, by a laser beam according to an image processing signal from image processor 83 by laser exposure 13, toner images are formed on photosensitive drums 228Y to 228BK and on the first side of sheet of paper P conveyed by conveyor belt 227, a full-color toner image is printed. Hereafter, the sheet of paper is fixed by fixing device 232, then is turned upside down via duplex device 234, and is re-conveyed to aligning rollers 224. At this time, sheet of paper P is thermally constricted by fixing.

Next, using image forming units 230Y to 230BK, toner images are formed on photosensitive drums 228Y to 228BK and on the second side of sheet of paper P conveyed by conveyor belt 227, a full-color toner image is printed. At this time, to laser driver 13*a* and polygonal mirror drive motor driver 13*b*, main scanning magnification Sp2 and reference position deviation amount $Z_{CR}$ in the main scanning direction which are stored in RAM 58 are applied and according to a correction signal when double-side horizontal deviation correction is executed to an image processing signal from image processor 83, laser exposure 13 is driven. Therefore, on the second side of sheet of paper P re-conveyed, a toner image which has main scanning magnification Sp2 and is shifted by $Z_{CR}$ in the main scanning direction is printed.

Hereafter, sheet of paper P, after double-side images are formed via fixing device 232, is ejected. When a predetermined time elapses after end of the double-side image forming process and thermally shrunk sheet of paper P is restored to its original size, in toner images printed on the first side and second side of sheet of paper P, the main scanning magnifications are the same and the horizontal deviation of the images on both sides is corrected.

According to the second embodiment, the passing waveforms of correction patterns 70 and 71 printed on conveyor belt 227 and correction patterns 72 and 73 fixed on the first side of sheet of paper P are measured by detection sensors 41 and 42 and from the measured results, main scanning magnification Sp2 and center position deviation amount $Z_{CR}$ for double-side horizontal deviation correction can be obtained with high accuracy. Therefore, in the same way as with the first embodiment, without executing a high degree of control by an expensive line sensor, double-side printed images of high quality free of horizontal deviation on the first and second sides of sheet of paper P can be obtained. Further, detection sensors 41 and 42 are moved and correction patterns 70 and 71 on conveyor belt 227 and correction patterns 72 and 73 on sheet of paper P are measured by same detection sensors 41 and 42, so that in the same way as with the first embodiment, when measuring correction patterns 70 and 71 and correction patterns 72 and 73, measurement errors caused by the characteristics of the detection sensors can be prevented and the measurement accuracy can be improved.

Next, the third embodiment of the present invention will be explained. In the third embodiment, unlike the second embodiment, toner images formed on the photosensitive drums are primarily transferred onto the intermediate transfer belt, are color-superimposed on the intermediate transfer belt, and then are secondarily transferred onto a sheet of paper in a batch. To the same parts as those of the constitution explained in the second embodiment, the same numerals are assigned and the detailed explanation thereof will be omitted.

Figure 11:
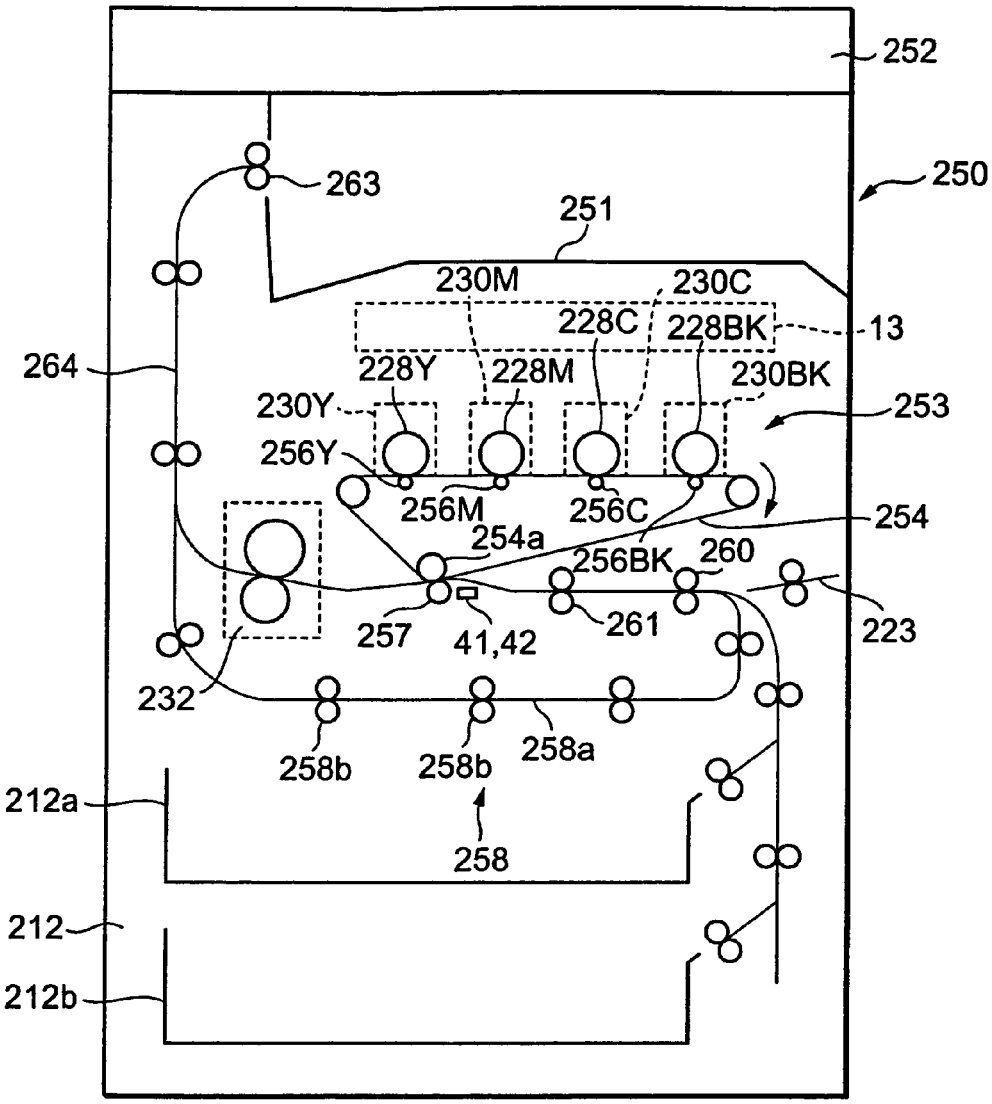
FIG. 11 is a block diagram schematically showing the essential section of the digital copier of the third embodiment of the present invention.

FIG. 11 is a schematic block diagram showing the whole of digital copier 250 of a 4-each tandem type. Digital copier 250 has a scanner 252 almost similar to that of the second embodiment above paper exit 251. Photosensitive drums 228Y to 228BK and image forming units 230Y to 230BK of printer 253 are arranged along intermediate transfer belt 254 rotating in the direction of arrow w. The primary transfer position where intermediate transfer belt 254 makes contact with photosensitive drums 228Y to 228BK is supported by primary transfer rollers 256Y to 256BK for applying a primary transfer bias voltage. To the secondary transfer position supported by driving roller 254*a* of intermediate transfer belt 254. secondary transfer roller 257 for applying a secondary transfer bias voltage is opposite.

Sheets of paper conveyed from paper supply device 212 and manual paper supply unit 223 are supplied to aligning rollers 261 via conveying rollers 260. On the downstream side of fixing device 232, exit guide 264 for ejecting sheet of paper P after fixing toward exit rollers 263 and duplex device 258 for re-conveying sheet of paper P toward aligning rollers 261 via exit guide 264 are installed. Duplex device 258 has reversing path 258*a* and reversing conveying rollers 258*b*.

Figure 12:
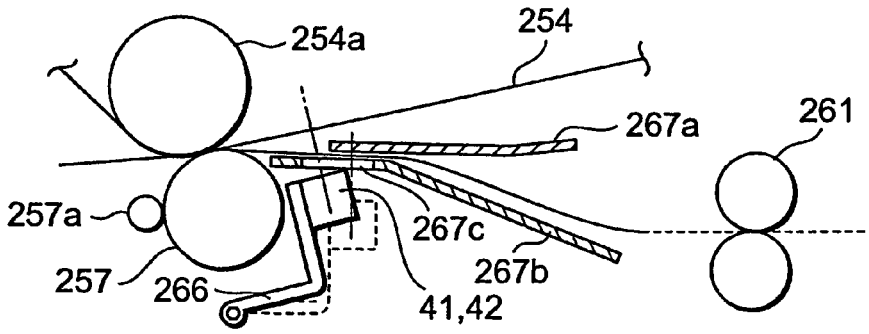
FIG. 12 is a partial block diagram showing the detection sensor of the third embodiment of the present invention.

As shown in FIG. 12, between aligning rollers 261 and fixing device 232, detection sensors 41 and 42 are installed. Detection sensors 41 and 42 are supported rotatably by moving device 266 toward intermediate transfer belt 254 and toward sheet of paper P guided by upper and lower conveying guides 267*a* and 267*b*. On lower conveying guide 267*b*, transparent window 267*c* for measuring correction patterns 70 to 73 by detection sensors 41 and 42 is formed. Secondary transfer roller 257 has cleaner 257*a* for cleaning adhered toner by correction patterns 70 and 71.

In the "double-side horizontal deviation adjustment mode" for double-side image forming, magenta (M) image forming unit 230M prints correction patterns 70 and 71 on intermediate transfer belt 254. Detection sensors 41 and 42, at the position indicated by a solid line in FIG. 12, measures the passing waveforms of correction patterns 70 and 71 on intermediate transfer belt 254. From the measured results, detection sensors 41 and 42 calculate ΔBF, ΔBR, and ΔBF+ΔBR, and when the calculated results are within predetermined tolerances, execute the "double-side horizontal deviation adjustment mode".

Next, detection sensors 41 and 42 secondarily transfer correction patterns 70 and 71 on intermediate transfer belt 254 on the first side of sheet of paper P by secondary transfer roller 257. Sheet of paper P on which correction patterns 72 and 73 obtained by transferring correction patterns 70 and 71 are printed is turned upside down after fixing by duplex device 258 and is re-conveyed toward secondary transfer roller 257. Detection sensors 41 and 42, at the position indicated by a dotted line in FIG. 12, measure the passing waveforms of correction patterns 72 and 73 fixed on the first side of sheet of paper P which is turned upside down by duplex device 258 and is re-conveyed. From the measured results, detection sensors 41 and 42 calculate ΔPF and ΔPR and furthermore, from the values of ΔPF and ΔPR, calculate main scanning magnification Sp2 and reference position deviation amount $Z_{CR}$ in the main scanning direction which are applied during the image forming process on the second side of sheet of paper P and store them in RAM 58.

During image forming in the double-side image forming mode, toner images formed on photosensitive drums 228Y to 228BK are color-superimposed on intermediate transfer belt 254 and a full-color toner image is secondarily transferred onto the first side of sheet of paper P in a batch by secondary transfer roller 257. Hereafter, the sheet of paper is fixed, then is turned upside down by duplex device 258, and is re-conveyed to aligning rollers 261. At this time, sheet of paper P is thermally constricted by fixing.

Next, on photosensitive drums 228Y to 228BK, toner images by a correction signal when double-side horizontal deviation correction is executed to an image processing signal are formed and then are color-superimposed on intermediate transfer belt 254, and a full-color toner image which has main scanning magnification Sp2 and is shifted by $Z_{CR}$ in the main scanning direction is printed in a batch on the second side of sheet of paper P. Hereafter, sheet of paper P, after the images are fixed on both sides via fixing device 232, is ejected. When a predetermined time elapses after end of the double-side image forming process and thermally shrunk sheet of paper P is restored to its original size, in toner images printed on the first side and second side of sheet of paper P, the main scanning magnifications are the same and the horizontal deviation of the images on both sides is corrected.

According to the third embodiment, correction patterns 70 and 71 printed on intermediate transfer belt 254 and correction patterns 72 and 73 fixed on the first side of sheet of paper P are detected by detection sensors 41 and 42 and from the detected results, main scanning magnification Sp2 and center position deviation amount $Z_{CR}$ for double-side horizontal deviation correction can be obtained with high accuracy. Therefore, in the same way as with the second embodiment, a high degree of control by an expensive line sensor is not necessary and double-side printed images of high quality free of horizontal deviation on the first and second sides of sheet of paper P can be obtained. Further, detection sensors 41 and 42 are moved and correction patterns 70 and 71 on intermediate transfer belt 254 and correction patterns 72 and 73 on sheet of paper P are detected by same detection sensors 41 and 42, so that in the same way as with the second embodiment, when detecting correction patterns 70 and 71 and correction patterns 72 and 73, measurement errors caused by the characteristics of the detection sensors can be prevented and the detection accuracy can be improved.

Further, the present invention is not limited to the aforementioned embodiments and can be variously modified within the range of the present invention, and for example, the number of toner images and color kind of the image forming apparatus are not limited, and a monochromatic image forming apparatus may be used. Further, the shape and size of correction patterns are neither limited and any patterns capable of passing a detection means, thereby recognizing thermal shrinkage of a recording medium may be acceptable. Furthermore, distance Ws between detection means arranged in the main scanning direction is optional. However, to obtain higher detection accuracy, distance Ws is preferably longer. Further, to execute horizontal deviation correction of smaller sheets of paper, it is possible to increase the number of detection means in the main scanning direction and read correction markers at narrower intervals printed on sheets of paper.

Further, the main scanning magnification and reference position deviation in the main scanning direction on either of the first side and second side of a recording medium may be corrected. Further, in the third embodiment, on the transparent window for detecting correction patterns 70 to 73 by detection sensor 41 and 42, a wiper for removing splashed toner may be installed.

As mentioned above, according to the embodiments of the present invention, at the time of horizontal deviation correction during double-side image forming, changes in predetermined paired correction patterns caused by thermal shrinkage of a recording medium are detected by measurement of the passing waveforms of the correction patterns, and from the measured results, the main scanning magnifications on the first side and second side due to thermal shrinkage are calculated, and the reference position deviation amount in the main scanning direction is calculated, and from the calculated results, the main scanning magnification and deviation amount in the main scanning direction on either of the first side and second side of the recording medium can be controlled. Therefore, without using an expensive line sensor for detecting the edge of a recording medium, the horizontal deviation during double-side image forming can be corrected at low lost and with high accuracy and double-side images of high quality can be obtained.

What is claimed is:

1. An image forming apparatus having an image deviation correction function, comprising:

an image forming portion having a toner image forming unit to form a toner image on an image carrying member, a transfer unit for transferring the toner image on the image carrying member to a recording medium, a fixing unit for heating and fixing the toner image on the recording medium, and a re-conveying unit for re-conveying the recording medium with the toner image fixed on to the transfer unit, wherein the toner image can be formed on both sides of the recording medium;

a first memory unit to store correction patterns for image adjustment when forming the toner image on the both sides of the recording medium;

a measured member on which the correction patterns are printed;

an image adjustment controller to control the toner image forming unit so as to print a pair of the correction patterns respectively on the recording medium and the measured member in a main scanning direction;

first measuring means for measuring passing waveforms of the paired correction patterns printed on the measured member;

second measuring means for measuring passing waveforms of the paired correction patterns printed on the recording medium and then heated and fixed by the fixing unit;

a calculator to calculate a second ratio of "non-printed part passing time in a total length of the correction pattern" to "passing time through the total length of the pattern" from the second measured results by the second measuring means and from the calculation results, calculating a correction value of a main scanning magnification of the toner image and a correction value of a main scanning reference position at the time of toner image forming on a first side of the recording medium and at the time of toner image forming on a second side;

a second memory unit to store the correction value of the main scanning magnification and the correction value of the main scanning reference position; and a correction controller to, when form toner images on both sides of the recording medium, apply the correction value of the main scanning magnification and the correction value of the main scanning reference position to the toner image on either of the first side and the second side and control deviation correction in the main scanning direction.

2. The image forming apparatus having an image deviation correction function according to claim 1, wherein:

the transfer unit has a transfer belt to primarily transfer the toner image on the image carrying member and then secondarily transfer the toner image to the recording medium and the measured member is the transfer belt.

3. The image forming apparatus having an image deviation correction function according to claim 1, wherein:

the transfer unit has a conveyor belt to support and convey the recording medium during transferring the toner image to the recording medium from the image carrying member and the measured member is the conveyor belt.

4. The image forming apparatus having an image deviation correction function according to claim 1, wherein:

the paired correction patterns are formed in a relationship of a reflected image on a front side and a rear side around a center in the main scanning direction.

5. The image forming apparatus having an image deviation correction function according to claim 4, wherein:

the calculator calculates a first ratio of "non-printed part passing time in a total length of the correction pattern" to "passing time through the total length of the pattern" from the first measured results by the first measuring means, and confirms that the first ratios on the front side and the rear side and a sum of the respective first ratios on the front side and the rear side are within predetermined tolerances, and then from the second calculation results by the second measuring means, calculates the correction value of the main scanning magnification of the toner image and the correction value of the main scanning reference position.

6. The image forming apparatus having an image deviation correction function according to claim 4, wherein:

the calculator calculates the correction value of the main scanning magnification of the toner image from a sum of the respective second ratios of "non-printed part passing time in a total length of the correction pattern" to "passing time through the total length of the pattern" on the front side and the rear side and calculates the correction value of the main scanning reference position of the toner image from a difference between the respective second ratios of "non-printed part passing time in a total length of the correction pattern" to "passing time through the total length of the pattern" on the front side and the rear side.

7. The image forming apparatus having an image deviation correction function according to claim 4, wherein:

the paired correction patterns are patterns that a central part of a rectangle is cut off to a triangle.

8. The image forming apparatus having an image deviation correction function according to claim 1, wherein:

the first measuring means and the second measuring means are at least two light reflection type sensors that the first and second means are arranged at a predetermined interval in the main scanning direction.

9. The image forming apparatus having an image deviation correction function according to claim 1, wherein:

the first measuring means and the second measuring means serve as same measuring means and are arranged on a transfer side and an opposite side of the correction patterns of the recording medium via a conveying path of the recording medium.

10. The image forming apparatus having an image deviation correction function according to claim 9, wherein:

the detection means can change a measurement position at the time of measuring the correction patterns printed on the measured member and at the time of measuring the correction patterns printed on the recording medium.

11. An image forming apparatus having an image deviation correction function; comprising:

an image forming portion having a toner image forming unit to form a toner image on an image carrying member, a transfer belt to primarily transfer the toner image on the image carrying member and then secondarily transfer the toner image to a recording medium, a fixing unit to heat and fixing the toner image on the recording medium, and a re-conveying unit to re-convey the recording medium with the toner image fixed on to the transfer unit, wherein the toner image can be formed on both sides of the recording medium;

a first memory unit to store correction patterns for image adjustment when forming the toner image on the both sides of the recording medium;

an image adjustment controller to control the toner image forming unit so as to print a pair of the correction patterns respectively on the recording medium and the transfer belt in a main scanning direction;

first measuring means for measuring passing waveforms of the paired correction patterns printed on the transfer belt;

second measuring means for measuring passing waveforms of the paired correction patterns printed on the recording medium and then heated and fixed by the fixing unit;

a calculator to calculate a second ratio of "non-printed part passing time in a total length of the correction pattern" to "passing time through the total length of the pattern" from the second measured results by the second measuring means and from the calculation results, calculating a correction value of a main scanning magnification of the toner image and a correction value of a main scanning reference position at the time of toner image forming on a first side of the recording medium and at the time of toner image forming on a second side;

a second memory unit to store the correction value of the main scanning magnification and the correction value of the main scanning reference position; and a correction controller to, when form toner images on the both sides of the recording medium, apply the correction value of the main scanning magnification and the correction value of the main scanning reference position to the toner image on either of the first side and the second side and control deviation correction in the main scanning direction.

12. The image forming apparatus having an image deviation correction function according to claim 11, wherein:

the paired correction patterns are formed in a relationship of a reflected image on a front side and a rear side around a center in the main scanning direction.

13. The image forming apparatus having an image deviation correction function according to claim 12, wherein:

the paired correction patterns are patterns that a central part of a rectangle is cut off to a triangle.

14. The image forming apparatus having an image deviation correction function according to claim 11, wherein:

the first measuring means and the second measuring means are at least two light reflection type sensors that the first and second means are arranged at a predetermined interval in the main scanning direction.

15. The image forming apparatus having an image deviation correction function according to claim 11, wherein:

the first measuring means and the second measuring means serve as same measuring means and are arranged on a transfer side and an opposite side of the correction patterns of the recording medium via a conveying path of the recording medium.

16. The image forming apparatus having an image deviation correction function according to claim 15, wherein:

the detection means can change a measurement position at the time of measuring the correction patterns printed on the measured member and at the time of measuring the correction patterns printed on the recording medium.

17. An image forming apparatus having an image deviation correction function, comprising:

an image forming portion having a toner image forming unit to form a toner image on an image carrying member, a conveyor belt to support and convey a recording medium during transferring the toner image onto the recording medium from the image carrying member, a fixing unit to heat and fix the toner image on the recording medium, and a re-conveying unit to re-convey the recording medium with the toner image fixed on to the transfer unit, wherein the toner image can be formed on both sides of the recording medium;

a first memory unit to store correction patterns for image adjustment when forming the toner image on the both sides of the recording medium;

an image adjustment controller to control the toner image forming unit so as to print a pair of the correction patterns respectively on the recording medium and the transfer belt in a main scanning direction;

first measuring means for measuring passing waveforms of the paired correction patterns printed on the conveyor belt;

second measuring means for measuring passing waveforms of the paired correction patterns printed on the recording medium and then heated and fixed by the fixing unit;

a calculator to calculate a second ratio of "non-printed part passing time in a total length of the correction pattern" to "passing time through the total length of the pattern" from the second measured results by the second measuring means and from the calculation results, calculating a correction value of a main scanning magnification of the toner image and a correction value of a main scanning reference position at the time of toner image forming on a first side of the recording medium and at the time of toner image forming on a second side;

a second memory unit to store the correction value of the main scanning magnification and the correction value of the main scanning reference position; and a correction controller to, when form toner images on the both sides of the recording medium, apply the correction value of the main scanning magnification and the correction value of the main scanning reference position to the toner image on either of the first side and the second side and control deviation correction in the main scanning direction.

18. The image forming apparatus having an image deviation correction function according to claim 17, wherein:

the paired correction patterns are formed in a relationship of a reflected image on a front side and a rear side around a center in the main scanning direction.

19. The image forming apparatus having an image deviation correction function according to claim 18, wherein:

the paired correction patterns are patterns that a central part of a rectangle is cut off to a triangle.

20. The image forming apparatus having an image deviation correction function according to claim 17, wherein:

the first measuring means and the second measuring means are at least two light reflection type sensors that the first and second means are arranged at a predetermined interval in the main scanning direction.

21. The image forming apparatus having an image deviation correction function according to claim 17, wherein:

the first measuring means and the second measuring means serve as same measuring means and are arranged on a transfer side and an opposite side of the correction patterns of the recording medium via a conveying path of the recording medium.

22. The image forming apparatus having an image deviation correction function according to claim 21, wherein:

the detection means can change a measurement position at the time of measuring the correction patterns printed on the measured member and at the time of measuring the correction patterns printed on the recording medium.

* * * * *